US006547071B2

(12) United States Patent
Barber

(10) Patent No.: US 6,547,071 B2
(45) **Date of Patent: *Apr. 15, 2003**

(54) PERSONAL COMPUTER STORAGE AND SECURITY CASE

(75) Inventor: Peter M. Barber, Fergus (CA)

(73) Assignee: CompX International Inc., Mauldin, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/090,528

(22) Filed: Mar. 4, 2002

(65) Prior Publication Data

US 2002/0112977 A1 Aug. 22, 2002

Related U.S. Application Data

(63) Continuation of application No. 09/767,178, filed on Jan. 22, 2001, now Pat. No. 6,352,155.

(51) Int. Cl.[7] ..... B65D 85/00

(52) U.S. Cl. ..... 206/320; 206/752; 206/762; 312/208.4

(58) Field of Search ..... 206/747, 320, 206/742, 752, 754, 755, 762, 764, 749; 312/126, 127, 139.1, 208.1, 208.3, 208.4, 208.5, 270.1, 309; 190/102

(56) References Cited

U.S. PATENT DOCUMENTS 4,979,610 A * 12/1990 Thomas ..... 206/749
5,358,100 A * 10/1994 Wolff ..... 206/749
6,352,155 B1 * 3/2002 Barber ..... 206/320

* cited by examiner

*Primary Examiner*—Shian Luong
(74) *Attorney, Agent, or Firm*—Banner & Witcoff, Ltd.

(57) ABSTRACT

A storage and security case for a personal computer comprises a housing with fold over side platforms which raise and lower a support platform within the case to cover a personal computer stored within the case or expose the personal computer. The side platforms provide additional functions such as a storage tray for various materials and a mouse platform.

12 Claims, 3 Drawing Sheets

PERSONAL COMPUTER STORAGE AND SECURITY CASE

CROSS REFERENCE TO RELATED APPLICATION

This is a continuation of U.S. patent application Ser. No. 09/767,178, filed on Jan. 22, 2001, now U.S. Pat. No. 6,352,155 issued Mar. 5, 2002 for a Personal Computer Storage and Security Case for which priority is claimed.

DESCRIPTION OF THE PREFERRED EMBODIMENT

In a principal aspect, the present invention relates to a storage and security case for a personal computer, laptop computer, or other desktop item which may be subject to theft and to which ease of access is desirable.

Personal computers (laptops) have the capacity and capability of easy removal and transport from a desktop support arm or desktop support environment so that they may be transported by the user for use at a remote site. However, the removal of a personal computer (PC) and accompaniment thereof with its owner or user is not always desirable or practical. Thus, often a PC will be left at its desktop location or station while the owner is absent from that workstation. When the owner is not present, the personal computer is subject to theft. To overcome theft opportunities, various types of locking mechanisms have been developed to engage the personal computer and retain it at a workstation. For example, a cable lock is often attached to a computer case and locked into position at a workstation. To remove the personal computer, it is then necessary to use a key to access the lock, detach the cable and remove the computer and the attached cable from that station. Such security measures are useful and do provide a significant inhibition to personal computer theft. Nonetheless, there has remained the need for an improved method to enhance the security of personal computers maintained at a workstation.

SUMMARY OF THE INVENTION

Briefly, the present invention comprises a storage and security case for a personal computer comprised of a generally rectangular parallelpiped enclosure including a base, front and back panels, as well as foldable side panels. The foldable side panels are designed to fold and fit over the top of a personal computer within the case. Folding or pivoting the side panels from a position which covers the personal computer to a position wherein the side panels extend laterally from the sides of the case exposes the interior of the case and simultaneously causes a base plate within the interior of the case to automatically rise thereby raising the personal computer from the case for easy access by its user. Additionally, the front panel of the storage case may include a wrist pad so that the front panel may fold outwardly to support the wrists of the user which seeks to use the computer that has been raised from the case. The case includes a solid base plate which may be easily integrated with or attached to a keyboard support arm. The case may be removable from the support arm so that it may be carried by the user to provide an extra degree of security and protection when transporting the personal computer. Additionally, the case may include a locking mechanism which holds the folding side panels in a closed position to retain the personal computer within the case.

Thus, it is an object of the invention to provide a storage and security case for personal computers which completely encapsulates and surrounds the personal computer in a protective environment and which may be locked, but which when unlocked, provides for easy accessibility to the personal computer.

It is a further object of the invention to provide an improved storage and security case for a personal computer which may be locked so as to retain the personal computer within the case protected from external access.

Another object of the invention is to provide a storage and security case for a personal computer which may be incorporated with and used in combination with a keyboard support arm.

Yet another object and feature of the invention is to provide a storage and security case for a personal computer wherein a support plate within the case may operate to automatically raise the personal computer from within the case for easy access and use by the computer user.

A further object of the invention is to provide a storage and security case for a personal computer wherein pivotal side platforms move between a position which enshrouds or covers the personal computer to a position which totally exposes the computer and wherein the side platforms extend laterally from the opposite sides of a base plate which supports the computer.

Another object of the invention is to provide laterally projecting side platforms for a storage and security case for a personal computer wherein the side platforms serve as a support for a mouse or other elements associated with control and operation of the personal computer or which may also serve as storage trays for materials being used in association with the use of the personal computer.

Another object and feature of the invention is to provide an inexpensive yet highly secure and reliable and rugged security case for a personal computer which may be transported with the computer.

These and other objects, advantages and features of the invention will be set forth in the detailed description which follows.

BRIEF DESCRIPTION OF THE DRAWING

In the detailed description which follows, reference will be made to the drawing comprised of the following figures.

DETAILED DESCRIPTION OF THE PREFERRED EMBODIMENT

Figure 1:
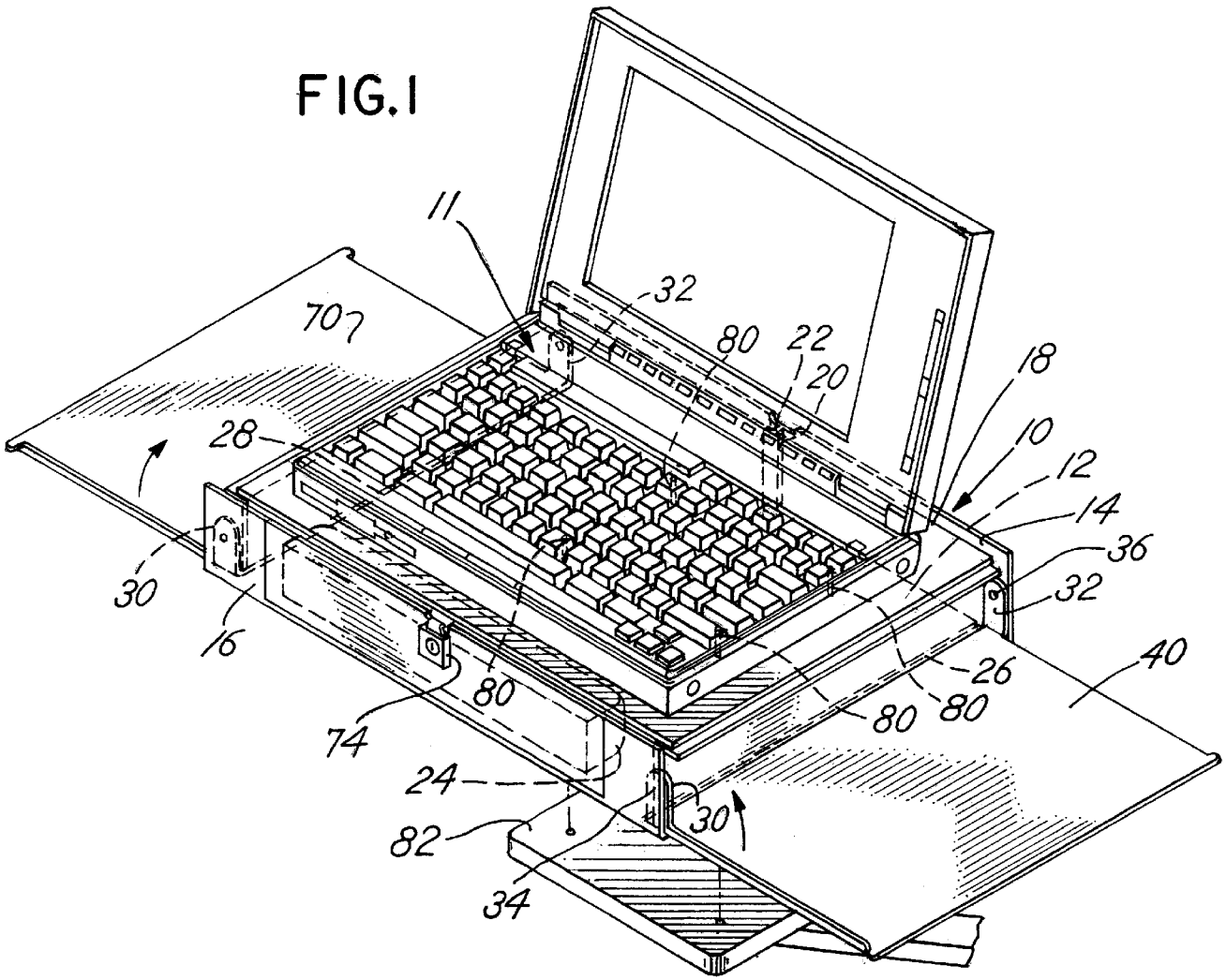
FIG. 1 is an isometric view of the personal computer storage and security case wherein portions thereof are partially cut away and wherein the security case is mounted on a keyboard support arm.

The storage and security case of the invention includes a housing 10 which comprises a planar, generally rectangular, base plate 12, a back side plate 14 and a front side plate 16. The base plate 12 is rectangular and is designed to be slightly larger than the profile defined by most personal computers. The size and configuration of the base plate 12, however, may be customized for any particular shape and personal computer size. The front and back sides 14 and 16 are generally rectangular and have a height greater than the thickness of a closed personal computer wherein the top and bottom halves of the computer have been folded together. Thus, the housing 10 defines an enclosure into which a personal computer 11 may be fitted.

A support plate 18 is positioned over the base plate 12. Support plate 18 has a shape which is generally rectangular. The support plate 18 preferably has a profile which fits within the profile of the base plate 12. Further, the support plate 18 typically includes a projecting aligning tab 20 along a back side which cooperates with a rib 22 on the inside of the back panel 14 to thereby retain the support plate 18 properly aligned within the cavity defined by the housing 10 as the support plate 18 moves vertically upwardly and downwardly in a manner to be described below. Again, the particular configuration and shape of the support plate 18 is optional. The function of the plate 18 is to support a personal computer 11 and to cause that personal computer 11 to rise in accord with the operation of the security case as described below. The utilization of a rib 22 and keyed projection or tab 20 as described also is optional and one or more of such keyed elements may be provided to facilitate alignment and movement of the base plate 18 over base plate 12.

Another optional feature of the housing 10 relates to the front panel 16. The panel 16 may be hinged to the base plate 12 so that it will pivot outwardly as depicted by the arrows in FIG. 1. Appropriate stops may be provided to limit the pivot movement of the front panel 16. The inside of the front panel 16 may include a wrist rest 24 shown in phantom in FIG. 1. Thus, the front panel 16 may be pivoted outwardly and partly downwardly, if desired to expose the wrist rest 24 so that a personal computer 11 retained within the case can be accessed and operated easily by an operator who will rest his or her wrists on the wrist rest 24. Front panel 16 may be actuated by a linkage or a cam mechanism linking side platforms 40, 70 (described below) to effect pivotal motion between a closed and open position.

The base plate 12 further includes a first side edge 26 and a second, parallel side edge 28 which extend between the front panel 16 and the back panel 14. The side edges 26 and 28 terminate at each end with upwardly extending hinge members 30 and 32 that include pivot pin openings 34 and 36 respectively. The hinge members 30 and 32 are thus integral with the front panels 16 and the back panel 14, although, in the event the front panel 16 is designed to be hinged to the base plate 12, then the hinge members 30 remain fixed and extending upwardly from the base plate or panel 12.

Figure 3:
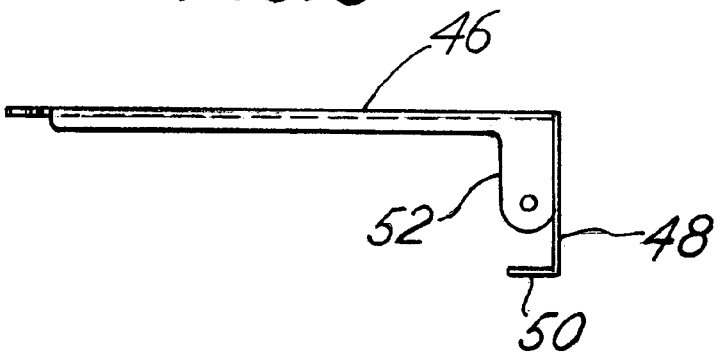
FIG. 3 is a side elevation of a first side platform associated with the assembly of FIG. 2.
Figure 4:
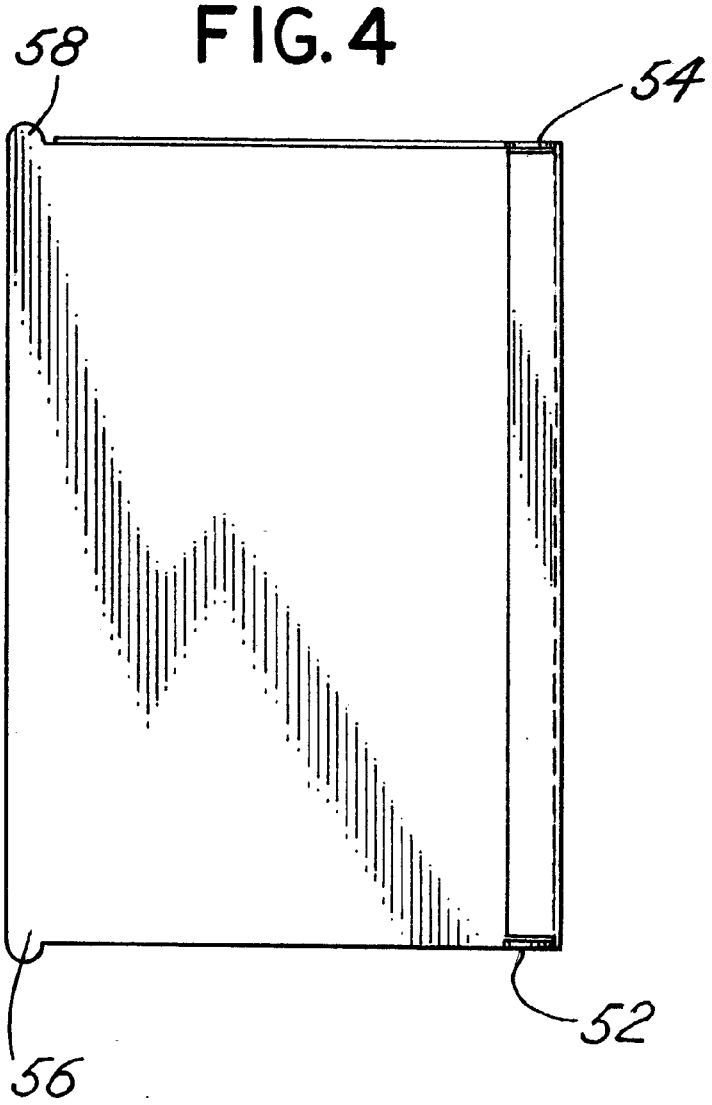
FIG. 4 is a top plan view of the side platform of FIG. 3.

A first side platform 40 is attached to the upwardly extending hinge members or sections 30 and 32 and thus is attached to the housing 10. More specifically, a first side panel 40 is depicted in greater detail in FIGS. 3 and 4 and includes a flat planar platform member 46, a depending side section 48, an inwardly extending cam member 50 and downwardly extending hinge sections 52 and 54 at the opposite ends thereof. As depicted in FIG. 4, the platform 46 also includes outwardly projecting stop members 56 and 58 which are designed to engage against the top edge of panels 16 and 14 respectively, when the platform 40 is in the position shown in FIG. 3 and before pivoting to the position shown in FIGS. 1 and 2.

Figure 2:
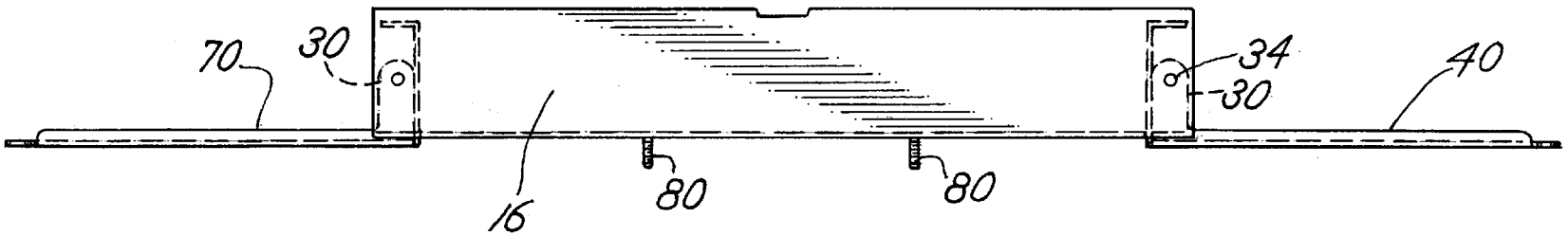
FIG. 2 is a front elevation of the assembly of FIG. 1.
Figure 6:
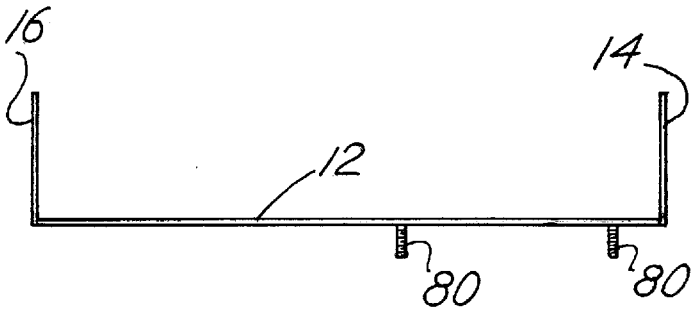
FIG. 6 is a front plan view of the housing of FIG. 5.
Figure 5:
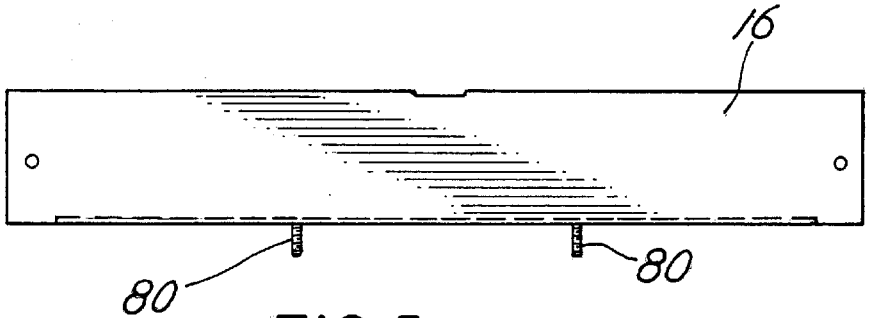
FIG. 5 is an end view of the housing including the base plate utilized in the assembly of FIGS. 1 and 2.

The first side platform 40 thus includes a platform section 46 which extends approximately one-half of the distance over the base plate 12 and support plate 18. Hinge pins attach the hinge members 52 and 54 through the hinge openings 34 and 36 so that the first platform 40 may be pivoted between a position which covers the base plate 12 and a position where it is fully open with respect to the base plate 12 as illustrated in FIGS. 1 and 2. Note that the edge of the side surface 48 engages against the edge 26 of the base plate 12 to limit the pivotal motion of the first platform 40 toward an open position. The component parts may be reinforced to rigidly hold these component parts in position. Additionally, the angle which the platform 40 forms with the base plate 12 may be controlled or adjusted by the position of the edge 26 and the side panel 48.

A second side platform 70 comprises a mirror image of the first platform 40 is provided for cooperation with the hinge members 30, 32 associated with the side edge 28 of the base 12 and operates in a similar fashion. The second platform 70 thus covers the left hand side of the base plate 12 and support plate 18. Support plate 18 is engaged by the camming face or surface 50 so that when the first platform 40 and second platform 70 are moved to the open position, the support plate 18 is raised by a camming action to thereby raise a personal computer 11 positioned on the support plate 18. The inward extension camming surface 50 also encloses a space or gap associated with the edges 26 and 28 between base 12 and platforms 40, 70 when the platforms 40 and 70 are in the closed position.

Projecting tabs 56 and 58 of platforms 40, 70 may be gripped or engaged by a lock 74 to hold the platforms 40 and 70 in the closed position. In this manner, the case defined by the described members comprises a security housing for the personal computer 11 precluding access and removal thereof. In practice, the base 12 may include downwardly projecting locking studs 80 which fit into a support platform 82 associated with a computer support arm assembly 84. Thus, the security case of the invention may be permanently affixed to a computer keyboard support platform. Alternatively, a locking mechanism may be associated with the studs 80 so that the case may be removed from the support arm 84 for transport of the case and its contents.

There has been set forth a preferred embodiment of the invention. Other embodiments incorporated in the features of the described invention may be provided. The construction of the caming surface, the shape and depth of the base plate 12, the shape and extent of the platforms 40 and 70, the position and construction of the lock 74, and the construction of the front panel 16 and whether it is hinged or unhinged may all be varied without departing from the spirit and scope of the invention. The invention is therefore to be limited only by the following claims and equivalents thereof.

What is claimed is:

1. A storage and security case for a personal computer comprising, in combination:

a base plate having a profile with a first lateral side edge, a second lateral side edge spaced from the first lateral side edge, a front edge and a back edge;

a first side platform pivotally attached to the first one of said base plate side edges, said side platform pivotal about the first lateral side edge between a position spaced from and over, at least in part, the base plate, and a position laterally at a side of the base plate;

a second side platform pivotally attached to the second one of said base plate side edges and pivotal about the second lateral side edge between a position spaced from and over, at least in part, the base plate, and a position laterally at a side of the base plate:

a support plate positioned over the base plate and having a support plate profile within the profile of the base plate; and lift cam members connected to each of the side platforms at the respective base plate side edges whereby pivotal rotation of each of the side platforms from a position over the base plate to a position exposing the base plate raises the support plate from the base plate to a position above and spaced from the base plate.

2. The case of claim 1 wherein the base plate includes an outside and including attachment members on the base plate outside for attachment of the case to a platform.

3. The case of claim 1 including a front panel at the front edge of the base plate extending upwardly to restrict access to the base plate and the support platform from the front edge.

4. The case of claim 1 including a back panel at the back edge of the base plate extending upwardly to restrict access to the base plate and the support platform from the back edge.

5. The case of claim 3 wherein the front panel is pivotal about the front edge of the base plate.

6. The case of claim 5 wherein the front panel includes an inside and an outside and wherein the inside includes a wrist support pad.

7. The case of claim 3 further including a cam mechanism for moving the front panel between an upwardly extending position and a position which provides access to the base plate.

8. The case of claim 1 wherein the side platforms pivot to cover the base plate support plate.

9. The case of claim 1 including a lock mechanism for locking the side platforms over the base plate.

10. The case of claim 1 including a guide member mounted on the base plate for maintaining the position of the support plate over the base plate as the support plate is raised from the base plate.

11. The case of claim 1 including a stop mechanism for holding at least one side platform in an extension position.

12. The case of claim 1 wherein the lift cam members comprise extensions of the side platform, and said side platforms are pivotal about an axis extending along the lateral side edge and above the plane of the base plate.

* * * * *